US005704266A

United States Patent [19]

Takehara

[11] Patent Number: 5,704,266

[45] Date of Patent: Jan. 6, 1998

[54] FIBER CUTTING APPARATUS

[75] Inventor: Katsuomi Takehara, Mukou, Japan

[73] Assignee: Kabushiki Kaisha Takehara Kikai Kenkyusho, Nagaokakyo, Japan

[21] Appl. No.: 568,229

[22] Filed: Dec. 6, 1995

[30] Foreign Application Priority Data

Dec. 26, 1994 [JP] Japan ..... 6-340961
Jul. 10, 1995 [JP] Japan ..... 7-207292

[51] Int. Cl.[6] ..... B26D 1/62; B26D 7/18

[52] U.S. Cl. ..... 83/114; 83/346; 83/913

[58] Field of Search ..... 83/346, 913, 114, 83/121, 145, 168, 146

[56] References Cited

U.S. PATENT DOCUMENTS

| | | | |
|---|---|---|---|
| 2,107,293 | 2/1938 | Gray | 83/145 X |
| 2,329,056 | 9/1943 | Keller | 83/114 X |
| 3,777,610 | 12/1973 | Spaller, Jr. | 83/346 |
| 3,826,163 | 7/1974 | Spaller, Jr. et al. | 83/346 |
| 3,915,042 | 10/1975 | Laird . | |
| 3,942,401 | 3/1976 | Roncato . | |
| 3,945,280 | 3/1976 | Roncato . | |
| 3,948,127 | 4/1976 | Vehling et al. | 83/913 X |
| 3,977,055 | 8/1976 | Gilpatrick | 83/168 X |
| 4,063,479 | 12/1977 | Roncato | 83/346 X |
| 4,083,276 | 4/1978 | Hutzezon . | |
| 4,141,115 | 2/1979 | Fourne et al. . | |
| 4,399,589 | 8/1983 | Hefti | 83/913 |
| 4,406,196 | 9/1983 | Roncato et al. | 83/913 X |
| 4,445,408 | 5/1984 | Keith | 83/913 |
| 4,528,877 | 7/1985 | Fleissner | 83/346 |
| 4,535,663 | 8/1985 | Shealy | 83/346 X |
| 4,598,619 | 7/1986 | Leeper et al. | 83/346 X |
| 5,003,855 | 4/1991 | Ciupak | 83/346 |
| 5,060,545 | 10/1991 | Keith et al. | 83/913 X |
| 5,163,348 | 11/1992 | Kitada et al. | 83/913 |

FOREIGN PATENT DOCUMENTS

| | | |
|---|---|---|
| 0 012 464 | 6/1980 | European Pat. Off. . |
| 2 242 491 | 3/1975 | France . |
| 50-116723 | 9/1975 | Japan . |
| 56-73118 | 6/1981 | Japan . |
| 56-73119 | 6/1981 | Japan . |
| 57-95314 | 6/1982 | Japan . |

OTHER PUBLICATIONS

Patent Abstracts of Japan, vol. 12, No. 373 (C-534), Oct. 6, 1988 & JP-A-63 126919 (Teijin Ltd), May 30, 1988 *summary*.

*Primary Examiner*—Eugenia Jones
*Assistant Examiner*—Charles Goodman
*Attorney, Agent, or Firm*—Wenderoth, Lind & Ponack

[57] ABSTRACT

The present invention is designed to wind a long continuous fiber around a rotor and to cut the fiber in prescribed lengths by blades positioned at intervals on the circumference of a rotor. Scrapers rotate together with the rotor in order to scrape out the cut fibers displaced between the blades in accordance with the reciprocal movement of the rotor in the axial direction. The use of scrapers makes it possible to prevent the over packing of the cut fibers disposed between the blades, as seen in the case of conventional apparatuses, and to forcibly discharge the cut fibers from between the blades. Consequently, the cutting ability improves remarkably, specifically in cases where the fiber to be cut is especially short.

6 Claims, 6 Drawing Sheets

FIBER CUTTING APPARATUS

BACKGROUND OF THE INVENTION

The present invention relates to a fiber cutting apparatus having radially positioned blades on a circumference of a rotating rotor. The fiber cutting apparatus operates by reciprocating in the axial direction while having layers of a long continuous fiber wound around the rotor. The fiber is then cut to a length proportionate to the intervals of the blades. The cut fibers, which are displaced along the circumference of the rotor and in between the blades, are then subsequently discharged.

Conventional fiber cutting apparatuses that make up the prior art include apparatuses having a number of radially positioned blades along the circumference of a rotor. The positioning of these blades correspond to a desired fiber length to be cut and operate by having layers of the long continuous fiber wound around the rotor. The prior art includes:

U.S. Pat. Nos.: 3,915,042, 3,942,401, 3,945,280 and 4,083,276.

Japanese Published Unexamined Patent Applications Nos.: No. Sho. 50(1975)-116,723, No. Sho. 56(1981)-73-118, No. Sho. 56(1981)-73,119 and No. Sho. 57(1982)-95, 314.

However, a problem exists when narrowing the intervals of the blades in order to cut the fiber into short pieces. The cut fiber accumulates and fills in between the narrow intervals of the blades and as such prevents the blades from cutting properly.

The above mentioned conventional fiber cutting apparatuses were designed using a rotor having a hollow cylindrical shape and positioning a number of long and narrow belt-shaped blades over two opposed disks in parallel with each other at intervals in the circumferential direction. The layers of fiber which were wound around the rotor and then cut by the blades were acted upon by a press roller which pressed down on the fiber and facilitated the winding and the discharging of the fiber.

Such conventional apparatuses had an advantage of being simple in structure, but had a great disadvantage in that the cut fibers would be packed in between the blades. This over-packing was especially true when cutting short lengths of fiber. The over-packing problem was due to the intervals of the radially positioned blades being too narrowly spaced.

Therefore, it was a problem for this kind of fiber cutting apparatus to discharge the cut fiber from the rotor while preventing such over-packing when the intervals between the blades were narrowly spaced.

SUMMARY OF THE INVENTION

The present invention discloses a fiber cutting apparatus designed to fix a cylindrical rotor to a rotary shaft, which rotates in one direction while reciprocating a distance in the axial direction. Provided on the circumference of the rotor are a number of blades which are positioned in parallel with each other along the shaft axis line at intervals in the circumferential direction. A long continuous fiber is supplied and wound around the circumference of the rotor and cut successively from the inside in short lengths corresponding to the intervals of the blades. A pair of large rotors form a fiber supplying space around the circumference of the rotor while having their circular inner sides, also known as axial ends, face each other. The large rotors support the rotary shaft while allowing reciprocal axial movement and rotation of the rotary shaft wherein the large rotors, rotary shaft and rotor all rotate together as one body. Provided on the inner sides of the large rotors are a pair of disk-shaped guide plates which hold the fiber supplied thereto at a fixed winding position against the reciprocal movement of the rotor. A pair of disk-shaped scrapers are put outside the two guide plates and form a cut fiber discharging space respectively between the scrapers and the guide plates. The scrapers include scraping points, which run along the circumference of the rotor between the blades, wherein the scraping points lead the cut fibers into the discharging space. Also being provided outside the fiber winding space, which is formed by the two guide plates, is a pressing object. This pressing object is positioned between the two guide plates and tightly supports, from an outside position to an inside position, the layers of the fiber being wound around the rotor, as well as the fibers being cut by the reciprocal movement of the blades.

In the apparatus of the present invention, the cut fibers are packed between the blades on the circumference of the rotor and are pushed out forcibly in the axial direction of the rotor by the scrapers which are disposed between the intervals of the blades. In other words, when the rotor rotates in one direction while moving to the right, the right-hand scrapers and scraping points run along the circumference of the rotor and push out the cut fibers to the left. As such, when the rotor moves to the left, the left-hand scrapers push out the cut fibers to the right. In such a manner, the two scrapers alternately push out the cut fibers along the blades from the right and the left; therefore, no over-packing takes place even when the blade intervals are narrowly spaced.

Furthermore, the cut fibers, which are pushed out transversely from between the blades, are discharged through the discharging spaces between the scrapers and the guide plates and then from between the inner sides of the large rotors.

In the present invention, when more than one roller is used as a pressing object to support the layers of fiber wound around the rotor, the thickness of the wound layers of fiber is reduced evenly along the circumference of the rotor. This reduces the loosening of the fiber on the rotor and improves the short fiber cutting capabilities of the present invention.

A belt-shaped pressing object is used to press the fiber to be wound around the rotor while forming a pressure contact section along the circumference of the rotor. The partial support by the rollers, as mentioned before, can be expanded to further reduce the loosening of the fiber layers. Thus, it becomes possible to perform even cutting of the fiber as well as improve accuracy.

Further, by using more than one auxiliary press roller in conjunction with the belt-shaped pressing object, the capability of the pressing object to press down on the fiber layers more evenly is improved.

DESCRIPTION OF THE PREFERRED EMBODIMENT

Figure 1:
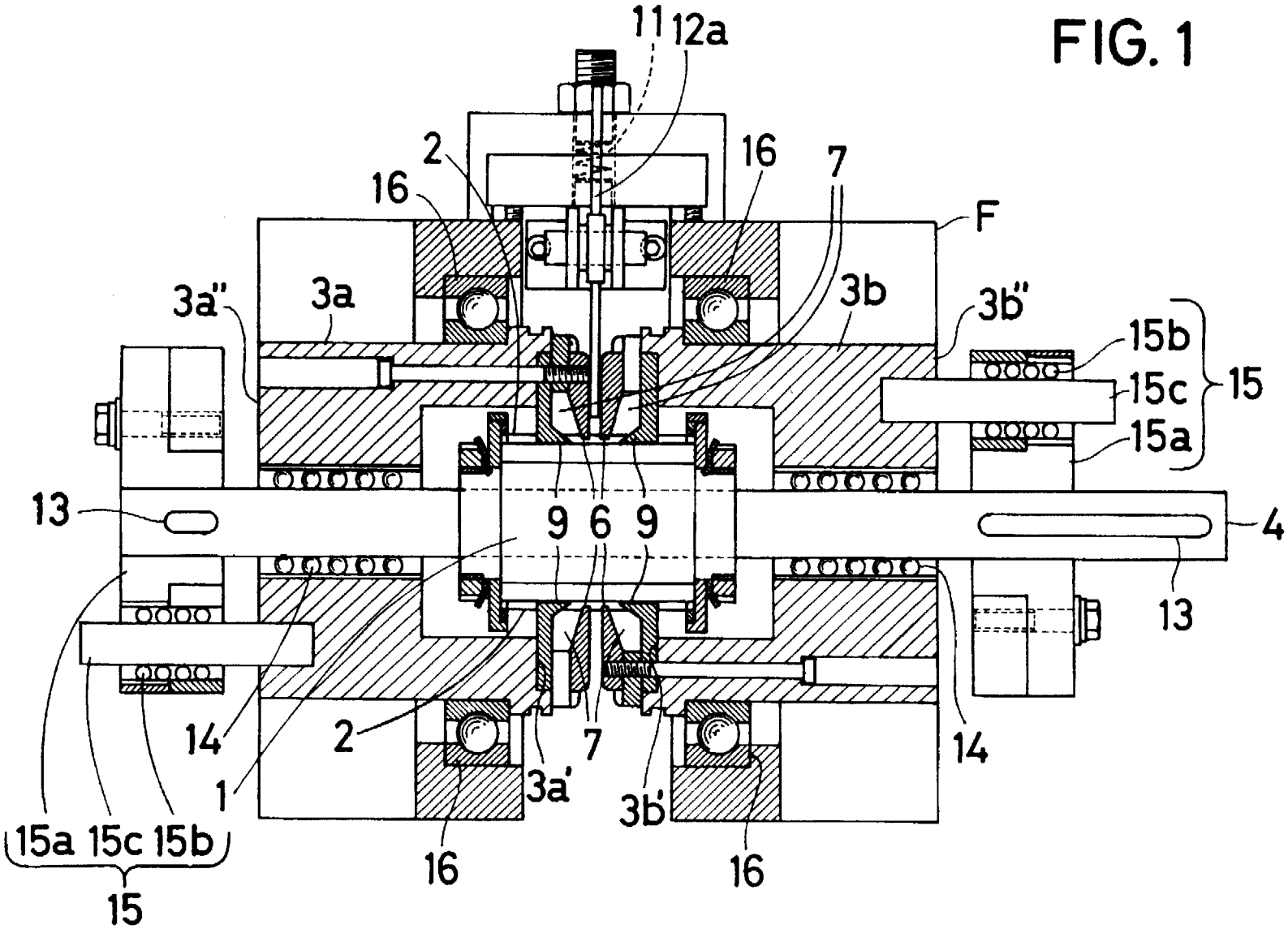
FIG. 1 is a vertical front view with a partial cross-section to show the structure of the first working example of the present invention.

The present invention consists of arranging the rotor 1, to which the fiber is wound, to rotate in one direction while moving in a reciprocal direction. Large rotors 3*a*, 3*b* are provided, these large rotors have inner sides 3*a*', 3*b*', also known as axial ends, which face each other along the circumference of the rotor 1 and thereby form a fiber supplying space 7. Provided between the inner sides 3*a*', 3*b*' are a pair of scrapers 9, 9 which include scraping points 9', 9' disposed between the blades 2, 2 which alternately scrape out the cut fibers from the rotor. Provided outside the fiber supplying space are pressing objects 12*a*, 12*b* which press the layers of wound uncut fiber onto the rotor and which also assist in the cutting of the fiber.

The working examples of the present invention are going to be described below with reference to the attached drawings. The first working example depicts a roller as the pressing object and is explained with reference to FIG. 1 as follows.

The cutting apparatus of the present invention is composed of a rotor 1 having a number of straight blades 2, 2 positioned on its circumference in parallel with its longitudinal axis at intervals corresponding to the length of fiber to be cut. A pair of large rotors 3*a*, 3*b* located on the outer surface of the rotor 1 form a fiber supplying space therebetween. The inner sides 3*a*', 3*b*', also known as axial ends, of the large rotors have a round shape and one position to face each other. The large rotors 3*a*, 3*b* include a center bore which support the rotary shaft 4 of the rotor 1. The large rotors 3*a*, 3*b* rotate together with the rotor 1 and the rotary shaft 4 as one body at a fixed position, while the rotary shaft 4 of the rotor 1 remains free to reciprocate in the axial direction.

The large rotors 3*a*, 3*b* are provided as two cylinders having axial ends, which are positioned to face each other. The rotor 1 rotates together with the large rotors 3*a*, 3*b* as one body in the same direction and is driven axially by a shaft-sliding device which is linked with the ends of the rotary shaft 4. The shaft-sliding device, not shown, reciprocally moves the rotary shaft 4 along its axial axis corresponding to the width of the fiber 5 to be supplied.

On the inner sides 3*a*', 3*b*' of the large rotors 3*a*, 3*b*, as shown in FIG. 1, are provided a pair of disk-shaped guide plates 6, 6. The guide plates 6, 6 are positioned in such a manner as to create a ring with respect to the rotor and include inner surfaces which run along the outer surface of the rotor 1. The space formed between the guide plates 6, 6 corresponds to the width of the layers of fiber 5 between them wherein the fiber is held in place by the inner surfaces of the guide plates 6.

Similarly on the inner sides 3*a*', 3*b*', are provided a pair of scrapers 9, 9 which are also ring shaped. The scrapers 9, 9 are situated adjacent the guide plates 6, 6 and form cut fiber discharging spaces 7, 7 respectively between the scrapers 9, 9 and the guide plates 6, 6. The scrapers 9, 9 extend along the outer surface of the rotor 1.

Figure 4:
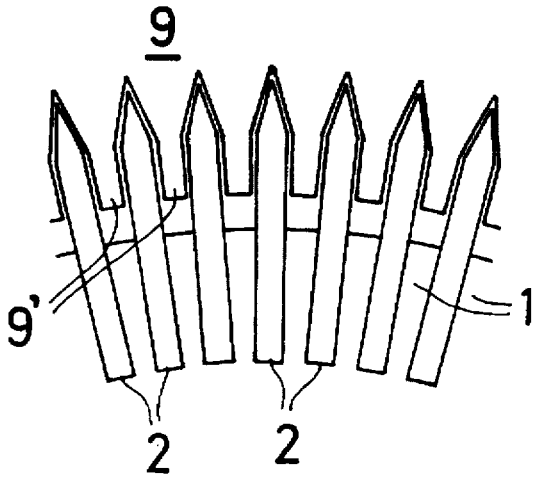
FIG. 4 is a magnified sectional view with a partial cross-section to explain the state of engagement between the blades on the circumference of the rotor and the scrapers.

The scrapers 9, 9 have scraping points 9', 9' which are situated along the circumference of the rotor 1, as shown in FIG. 1, and which follow the rotor outline between the blades 2, 2, as shown in FIG. 4.

Figure 2:
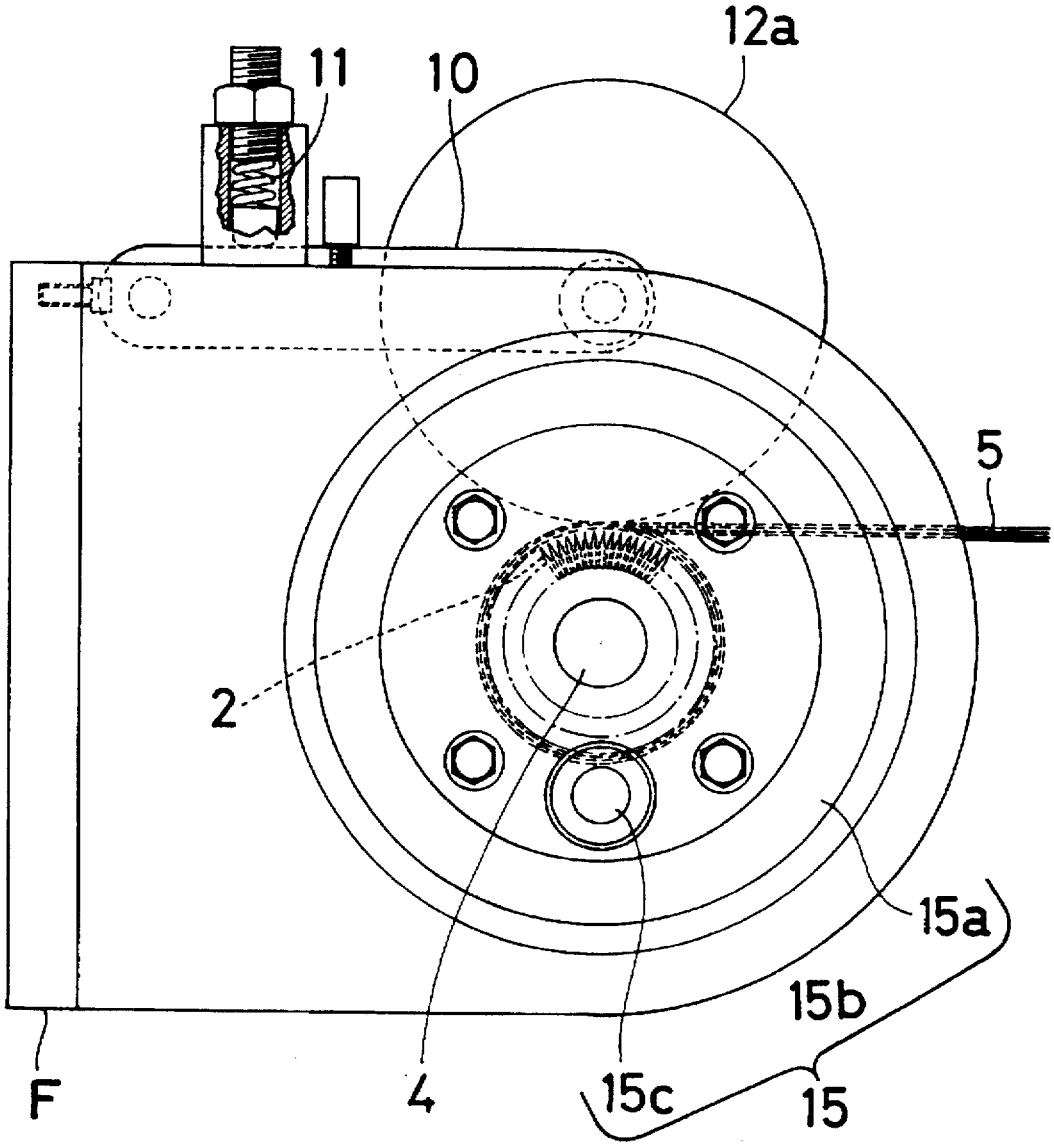
FIG. 2 is a side view of the first working example.

Further, outside the fiber winding position, formed by both guide plates 6, 6, is provided a roller shaped pressing object 12*a*, as shown in FIG. 2. The roller shaped pressing object rotates freely on an end of an arm 10. The arm is supported by the machine frame (F) at an opposite end thereof and is biased by a spring 11.

Figure 3:
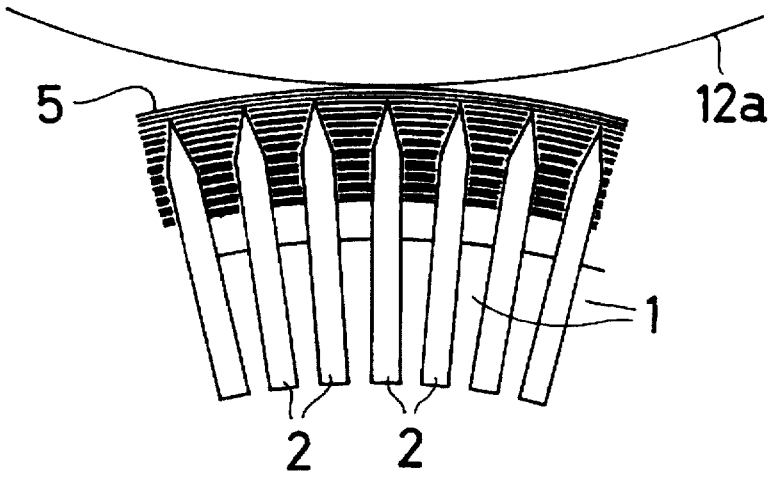
FIG. 3 is a magnified sectional view with a partial cross-section to explain the state of cutting the fiber.

As shown in FIG. 3, the pressing object 12*a* presses the layers of wound fiber 5 around the rotor 1 from an outside position. The pressing object 12*a* presses the fiber onto the rotor to prevent the loosening of the fiber when it is cut from an inside position by the reciprocating blades 2, 2.

As shown in FIGS. 1–4, the keys 13, 13 attach to both ends of the rotary shaft 4. The keys 13, 13 convey the rotation of the rotary driving system, not shown in the drawing, to the rotary shaft 4 independent of the reciprocal movement of the above mentioned shaft-sliding device. The linear bearings 14, 14 are used for supporting the large rotors 3*a*, 3*b* in order to permit the axial movement of the rotor 1. The rotation conveying means 15, 15 is composed of rings 15*a*, 15*a*, bearings 15*b*, 15*b* and coupling pins 15*c*, 15*c*, which are provided at both ends of the rotary shaft 4 and which convey the rotation of the rotary shaft 4 to the large rotors 3*a*, 3*b*. The bearings 16, 16 together with the machine frame (F) support the large rotors 3*a*, 3*b* in a manner which allows free rotation of the large rotors 3*a*, 3*b* with respect to the frame (F).

Now, the second working example is explained below with reference to FIGS. 5–7.

Figure 5:
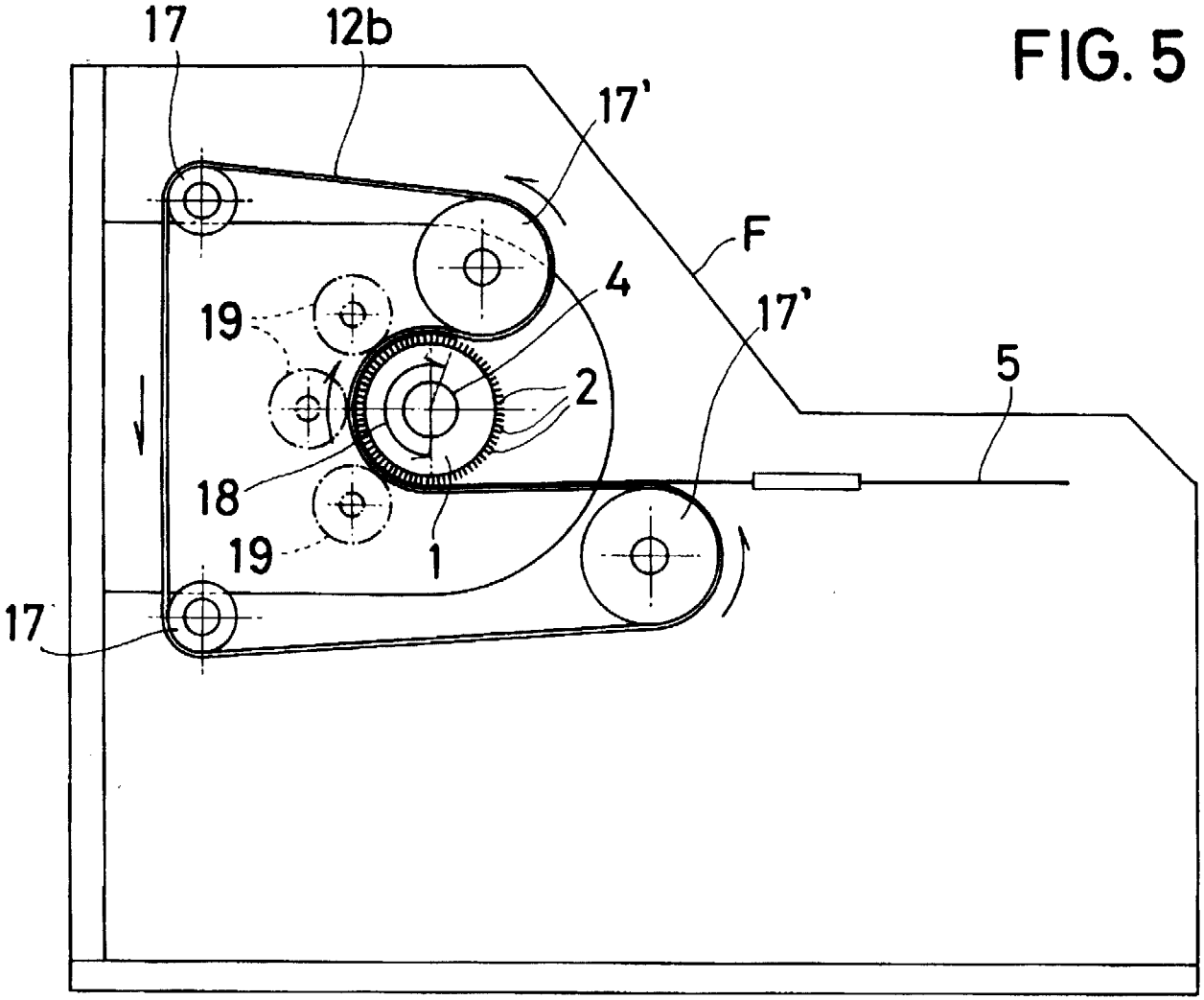
FIG. 5 is a vertical sectional view with a partial cross-section to show the structure of the second working example.

As shown in FIG. 5, the second working example has basically the same structure as the apparatus of the above-mentioned first working example. It consists of such elements as the: rotor 1 which rotates while reciprocating in the axial direction; a number of blades 2, 2 positioned along the circumference of the rotor 1; a pair of large rotors 3*a*, 3*b*, positioned along the circumference of the rotor 1 and include inner sides 3*a*', 3*b*', also known as axial ends, which are positioned to face each other; the large rotors 3*a*, 3*b* include a central bore which supports both ends of the rotary shaft 4, while the rotary shaft 4 remains free to reciprocate in the axial direction with respect to the large rotors 3*a*, 3*b*; the large rotors 3*a*, 3*b* rotate together with the rotor 1 and the rotary shaft 4; scrapers 9, 9 are provided on the inner sides 3*a*', 3*b*'; scrapping points 9', 9' on the ends of the scrapers 9, 9, which are situated along the circumference of the rotor 1 and disposed between the blades 2, 2; and discharging spaces 7, 7 for discharging the cut fibers disposed between the base of the scrapers 9, 9 and the guide plates 6, 6.

The second working example is provided with a belt-shaped pressing object 12*b*, which provides pressure to the fiber 5 wound around the circumference of the rotor 1. The pressure applied to the fiber 5 by the belt-shaped pressing object 12*b* assists in the cutting action of the reciprocating blades 2, 2. The second working example can also automatically supply the fiber 5 along the belt-shaped pressing object 12*b*.

Figure 6:
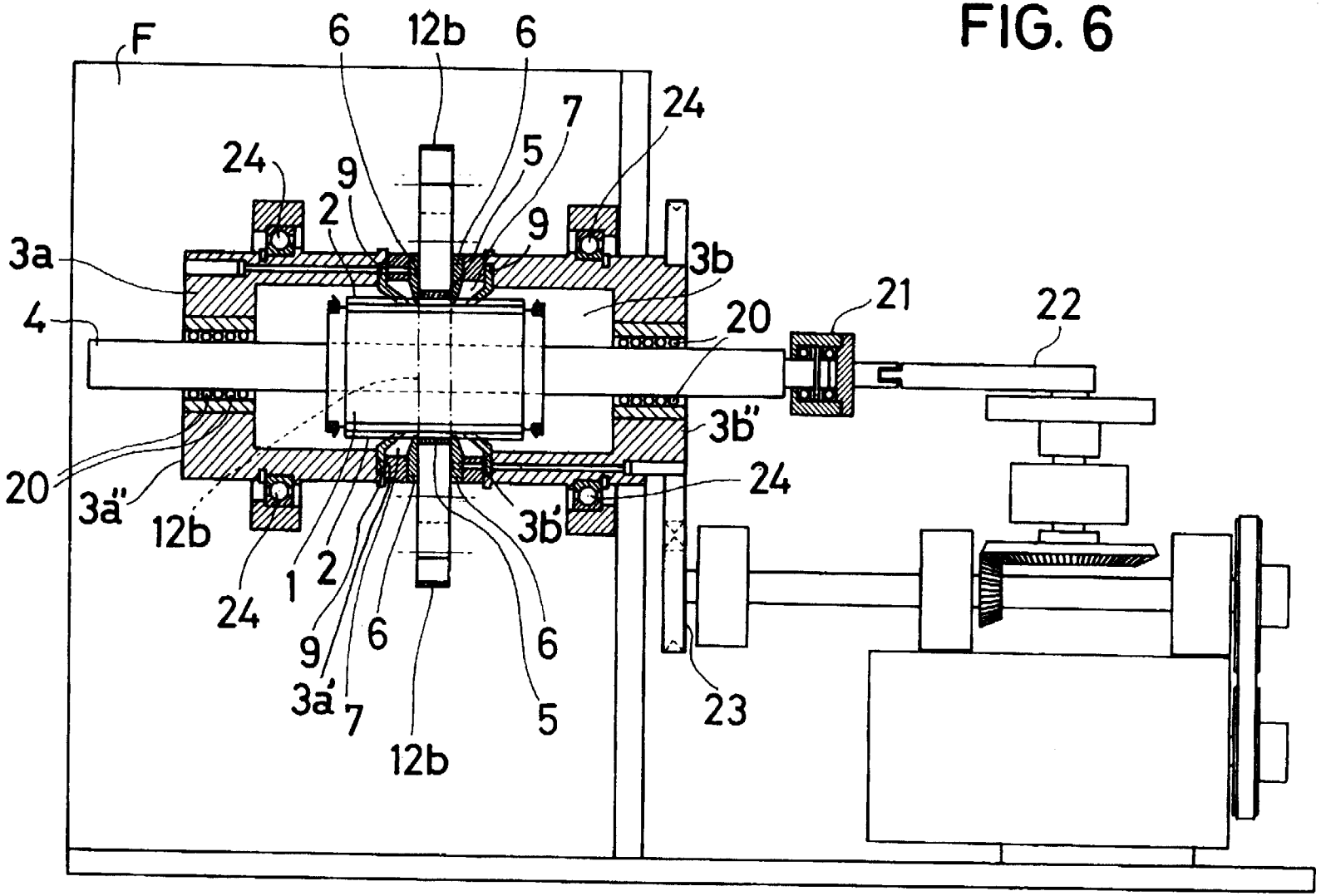
FIG. 6 is a side view to explain the second working example in principle.
Figure 7:
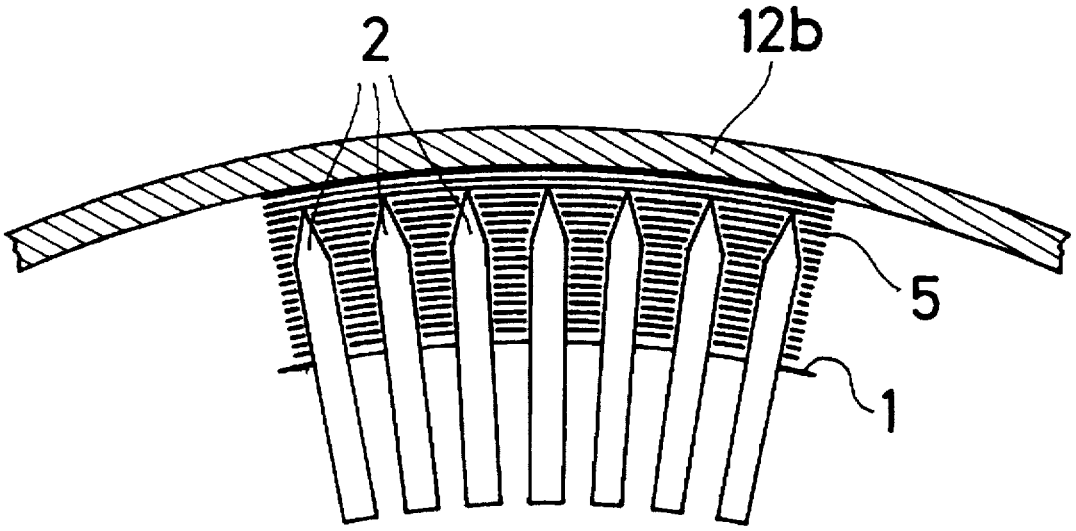
FIG. 7 is a magnified sectional view, with a partial cross-section, of the pressure contact section of the belt-shaped pressing object in the second working example.

As shown in FIG. 6, the pressing object 12*b* is positioned over the blades 2, 2 along one side of the rotor 1. The pressing object 12*b* presses down onto the wound fiber 5 while rotating in the same direction as the rotation of the rotor 1.

The second working example includes a pressure contact section 18 positioned along the circumference of the rotor 1 and between rollers 17, 17, which are arranged about the rotor 1. The rollers 17, 17 have shaft lines parallel with each other and are positioned outside the fiber winding space.

When tension rollers 17', 17' are positioned adjacent the rotor 1; a pressure contact section 18 is formed on the circumference of the rotor 1. This pressure contact section 18 has a length equal to more than half of the circumference of the rotor 1. The tension rollers 17', 17' supply tension to the belt-shaped pressing object **12*b* which in turn provide a desired pressure to the pressure contact section 18**.

Further, as shown in FIG. 5, auxiliary rollers 19, 19 can also be used to provide further tension on the belt-shaped pressing object **12*b* from a position outside of the pressure contact section 18. The use of the auxiliary rollers 19, 19 raises the tension of the belt-shaped pressing object 12*b* which in turn presses the fiber 5 onto the rotor 1. This added tension enables the blades 2, 2 to more accurately cut the fiber 5**.

As shown in FIG. 6, the second working example provides axial reciprocation of the rotary shaft 4 by supporting both ends of the rotary shaft 4. The rotary shaft 4 is supported by sides **3*a*", 3*b*" of the large rotors 3*a*, 3*b* via ball spline bearings 20, 20**.

The rotary shaft 4 of the second working example axially reciprocates by a crank-type shaft-sliding device 22 via a coupling 21 provided on one end (right-hand in the drawing) of the rotary shaft 4. It is driven to rotate by a rotary driving system 23 linked with the side **3*a*" of the large rotor 3*a* via the ball spline bearings 20, 20**.

The pair of large rotors **3*a*, 3*b* are supported by the machine frame (F) via radial bearings 24, 24 provided on their outer surfaces. The large rotors 3*a*, 3*b* rotate at the same speed as the rotor 1**.

As described above, the second working example, which uses the belt-shaped pressing object **12*b* in place of the roller-type pressing object 12*a*, can form a long pressure contact section to press the fiber 5 along the circumference of the rotor 1**. The pressing effect is greater as compared to the first working example and as such, the cutting of the fiber can be performed under higher tension so as too obtain highly accurate cut fibers. Thus, the cutting ability of the second working example is improved remarkably.

I claim:

1. An apparatus for cutting a length of fiber, said apparatus comprising:

a rotary shaft;

a rotor about which the fiber to be cut is to be wound, said rotor being coupled to said rotary shaft and said rotor including a plurality of blades;

a pair of large rotors axially spaced along said rotary shaft and having confronting axial ends defining a fiber supplying space;

said rotor, rotary shaft and large rotors are mounted to rotate together;

said rotor and rotary shaft being axially moveable with respect to said large rotors;

at least one pair of guide plates on said axial ends at positions directly opposed to one another;

at least one scraper on one of said axial ends, and a cut fiber discharging space being defined between said guide plates and said scraper;

wherein an axial movement of said rotor and said blades relative to said guide plates and said scraper causes said blades to cut the fiber to be cut and causes said scraper to move the cut fiber into said cut fiber discharging space; and a pressing object located between said guide plates for pressing the fiber onto said rotor during said rotational and axial movement of said rotor.

2. An apparatus for cutting a length of fiber, as claimed in claim 1, wherein said pressing object comprises at least one roller.

3. An apparatus for cutting a length of fiber, as claimed in claim 1, wherein said pressing object comprises at least one belt.

4. An apparatus for cutting a length of fiber, as claimed in claim 3, further comprising at least one roller with said at least one belt.

5. An apparatus for cutting a length of fiber, as claimed in claim 3, further comprising at least one tension roller for tensioning said at least one belt.

6. An apparatus for cutting a length of fiber, as claimed in claim 1, wherein said at least one scraper includes at least one pair of scrapers on said axial ends at positions directly opposed to one another.

* * * * *